United States Patent [19]

Orzechowski

[11] 4,126,541

[45] Nov. 21, 1978

[54] APPARATUS AND METHOD FOR REFINING ASBESTOS DISPERSIONS

[75] Inventor: John F. Orzechowski, Orange, Conn.

[73] Assignee: Raybestos-Manhattan, Inc., Trumbull, Conn.

[21] Appl. No.: 790,185

[22] Filed: Apr. 25, 1977

[51] Int. Cl.[2] ..... B07B 1/20

[52] U.S. Cl. ..... 209/240; 209/256; 209/273; 209/300; 209/261; 264/87; 264/101

[58] Field of Search ..... 209/250, 256, 258, 262, 209/273, 283, 306, 370, 300, 240, 261; 210/109, 112, 415; 162/55, 3; 134/25 R; 264/101, 87

[56] References Cited

U.S. PATENT DOCUMENTS

| | | | |
|---|---|---|---|
| 970,240 | 9/1910 | Kilborn | 209/300 |
| 1,077,947 | 11/1913 | Abrames et al. | 209/300 |
| 1,220,232 | 3/1917 | Jackson | 209/397 |
| 2,181,404 | 11/1939 | Koppitz et al. | 210/415 |
| 3,035,698 | 5/1962 | Novak | 209/235 |
| 3,947,314 | 3/1976 | Chupka et al. | 209/306 |
| 3,966,607 | 6/1976 | Gaynor et al. | 210/415 |

FOREIGN PATENT DOCUMENTS 710,540 6/1954 United Kingdom.

*Primary Examiner*—Robert Halper
*Assistant Examiner*—Jon Hokanson
*Attorney, Agent, or Firm*—Gary, Juettner & Pyle

[57] ABSTRACT

Apparatus for the refinement of colloidal asbestos dispersions comprises a horizontally disposed cylindrical tube having a plurality of closely spaced holes around the periphery thereof, a helical screw disposed within the tube, and a flanged jacket concentric with and spaced outwardly from the tube. A slurry of unrefined dispersion is continuously fed into the tube to fill it. Refined slurry is drawn through the holes by a suction pump connected to the jacket while contaminants are retained in the tube and moved by the screw to the outlet end of the tube where they are compacted and removed as sludge through a spring loaded discharge door.

6 Claims, 4 Drawing Figures

APPARATUS AND METHOD FOR REFINING ASBESTOS DISPERSIONS

This invention relates to a method and apparatus for the removal of contaminants from colloidally dispersed chrysotile asbestos fibers.

The invention more particularly relates to method and apparatus for refining such dispersions in a continuous manner and much more efficiently than heretofore possible.

In the production of asbestos yarn as taught, for example, by Novak and Orzechowski in U.S. Pat. No. 3,453,818, the yarn is formed by extruding colloidally dispersed asbestos fibers through extrusion nozzles into a coagulating liquid. The exit orifices of these extrusion nozzles can vary in both size and shape. For example, circular orifices can range from 0.020 inch to 0.125 inch. Orifices of elliptical, triangular or rectangular shape may have minimum openings within the above mentioned range of 0.020 to 0.125 inch.

The difficulty arises in that bagged asbestos as received for processing into yarn contains from 0.1% to 10.0% of foreign material or contaminants such as rock, wood, rubber, clots, unopened bundles of asbestos, spicules, wire, and the like. The physical dimensions of such contaminants are larger than the orifice or the slits of the extrusion nozzles. Therefore, if such particles are not removed, they will cause the nozzle orifices to become plugged, resulting in discontinuities in the formation of the yarn and interruption of yarn production. Nozzle plugging necessitates removal of the nozzles for cleaning by probing, backflushing, washing, etc.

There are many known methods of refining asbestos dispersions, none of which are entirely satisfactory. In one such prior art method, the dilute colloidal asbestos slurry is centrifugally forced through slotted screens. Another method comprises the forcing of the unrefined slurry through a filter screen having small holes with definitely prescribed spacing. The reason for the criticality of the hole diameter and spacing is that the long asbestos fibers present in dispersions suitable for yarn making tend to more rapidly clog the screening holes. In any event, the contaminants themselves, along with a certain amount of asbestos fibers, tend to clog the screen holes. Prior art refining devices, therefore, have utilized scrapers of various types which are moved across the filtering screen surface periodically for the purpose of keeping the screen holes open.

Despite such attempts to keep the screen holes open, plugging still occurs. In fact, cleaning of known prior art refining devices may be required as often as once per hour if excessively dirty fibers are introduced into the system. Even with fibers of normal average cleanliness, sufficient clogging occurs to require daily cleaning.

The apparatus and method of the present invention overcomes many of the disadvantages of prior art refining systems. Broadly, the present invention contemplates physically separating undesirable particles, or contaminants, from an incoming slurry of colloidally dispersed asbestos fibers, drawing off the refined dispersion for further processing, and conveying the contaminants toward a discharge end of the device where they are compacted and automatically ejected responsive to compaction pressure. The device is continuous in operation and virtually self-cleaning, thereby having greater efficiency and being more economical to operate than prior art devices.

Other advantages will be apparent from the following description of the preferredd embodiment of the apparatus and method, and the accompanying drawings wherein.

Figure 1:
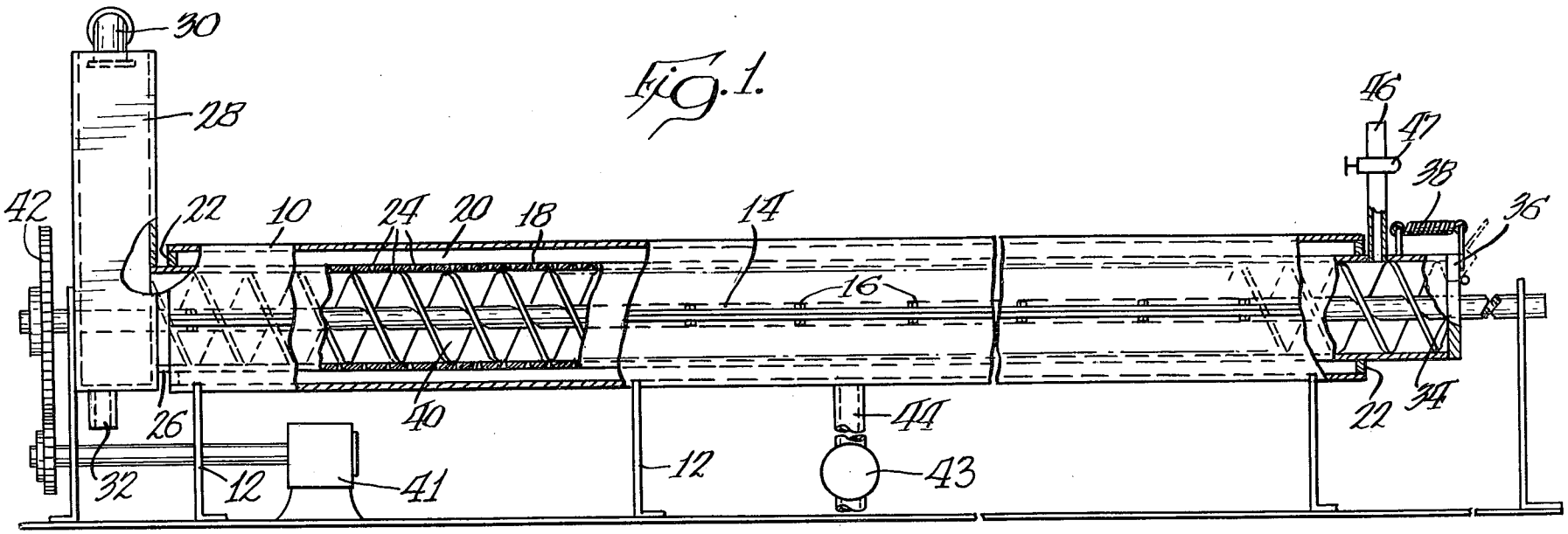
FIG. 1 is an elevational view, partially in section, of the apparatus for carrying out the process of this invention.

Referring to FIG. 1, the refining apparatus comprises a horizontally disposed, preferably cylindrical jacket 10 supported by suitable framework 12. For assembly and maintenance purposes, the jacket 10 may be formed in two halves, each provided with flanges 14 and fastened together by bolt and nut assemblies 16. The jacket obviously may be other than cylindrical, the cross sectional contour not being critical.

A cylindrical perforated tube 18 is disposed within the jacket 10 and radially spaced therefrom to form a chamber 20 closed at both ends by walls 22. The tube 18 is provided with a plurality of screen holes 24 around the entire periphery, the holes preferably being circular in cross section but alternately may be square or rectangular. The holes may be of a necessary suitable size dependent on the size of the nozzles which will be used in a subsequent yarn making process and can range between 0.001 to 0.125 inch from edge to edge at the smallest part.

Figure 4:
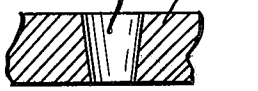
FIG. 3 and FIG. 4 are fragmentary sectional views showing preferred shapes of filtering holes.
Figure 3:
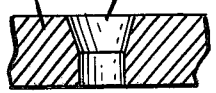
Figure 2:
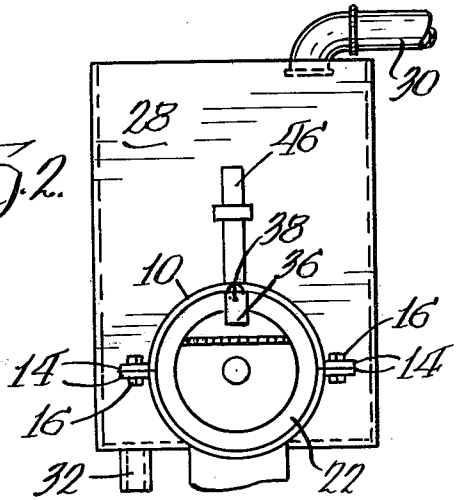
FIG. 2 is an end view of the discharge end of the apparatus of FIG. 1.

It has been found that there is less tendency for asbestos fibers to clog the holes if the holes are formed with at least a partial taper increasing in cross-sectional area toward the outside of the tube 18 as shown in FIG. 1. Two possible embodiments of screen holes are shown in FIG. 3 and FIG. 4.

The screen tube 18 projects beyond jacket 10 at the inlet end 26 and communicates with a supply reservoir 28 having inlet means 30 and drain means 32.

The screen tube 18 also projects beyond jacket 10 at the outlet or discharge end 34 which is closed except for a spring biased discharge door 36 held normally in closed position by spring 38.

Received within the tube 18 and extending the full length thereof is a screw 40 which may be driven through gear 42 at variable speeds by any suitable power source 41. The outer periphery of the screw is preferably polished and chrome plated for hardness so as to prevent binding as it rotates within the screen tube and also to provide good scraping action along the full length of the tube.

While in the preferred embodiment the screw periphery should be in contact with the inner wall of the tube, it will be appreciated that as a practical matter this condition will be difficult to achieve. However, any clearance which will be provided should be held to a maximum of about 0.025 inch to ensure positive removal of fibers and residue from the holes and to provide positive conveyance of debris to the discharge end of the tube as will be explained later.

As mentioned heretofore, the periphery of the screw conveyor may be chrome plated or, alternately may be case hardened or equipped with flexible, replaceable strips of hard rubber, teflon, polypropylene, polyethylene, alloy steel, or the like so as to provide good scraping characteristics.

It has been found that air and foam at times accumulate toward the discharge end of screen tube 18. To alleviate this condition, a vent tube 46 and a shut-off valve 47 may be provided, the vent tube communicating with the screen tube 18 to bleed off foam and air from the compacting dispersion.

In operation, unrefined dispersion, containing about 0.1% to 4.0% solids, enters the device through inlet 30 and reservoir 28 in which a constant level head, well above the horizontal tube entrance, is maintained by any conventional means such as an overflow or a float control device (not shown). The head level must be high enough so that a vacuum seal may be maintained on the screen holes 24 as will become evident.

The unrefined dispersion, or slurry, is drawn into the tube 18 and fills it completely. A variable speed pump 43 connected to an outlet pipe 44 creates a suction in chamber 20 and pulls refined disperson through the screen holes of tube 18 into the chamber 20 and from there removes it through outlet pipe 44 for further processing such as spinning into yarn.

Simultaneously, the screw 40 is rotated at the desired speed and conveys the debris and contaminants, which are too large to pass through screen holes 24, to the discharge end 34 of the tube. When the residue of contaminants becomes sufficiently compacted and dewatered, that is to a concentration of about 20% to 40% solids, its viscosity permits it to be rotated by the action and strategic location of the screw. As additional residue accumulates, pressure is built up so as to force open the spring biased discharge door 36 through which the residue is continuously expelled to be properly collected and disposed of. It will be noted that preferably the screw will extend to the extreme outlet end of tube 18 to ensure that the screw thrust will overcome the friction between the residue and the tube wall and thus eject the residue.

The above described apparatus and method refines colloidal asbestos dispersions much more quickly and efficiently than prior art devices. Furthermore, it has been determined that the apparatus of this invention requires very little down time for cleaning purposes. For example, it has been thought that the distance between screen holes was extremely critical and had to be greater than the length of the asbestos fibers in the slurry. Utilizing the screw means of the present invention, the distance between screen holes may be reduced to about three-quarters of the length of the asbestos fibers. This spacing is adequate, because of the greater wiping action of the screw, to prevent "bridging" of fibers between adjacent holes and also allows about a 25% increase in effective screen area.

It should be noted that, if desired, the effectiveness of the continuous cleaning of the screen holes can be monitored by means of a vacuum gage (not shown) installed in the suction line, or outlet pipe, 44. Clogged holes will result in an increased vacuum while the cleaning of holes will result in a decreased vacuum.

I claim:

1. Apparatus for removing contaminants from a slurry of colloidally dispersed asbestos fibers comprising: a horizontally disposed cylindrical jacket; a cylindrical perforate screen tube internally of said jacket and concentric therewith, the screen tube having an inlet end and an outlet end and being spaced from the jacket to form a chamber therebetween; a screw disposed for rotation within the screen tube, said screw extending to the extreme outlet end of said tube; means for feeding slurry into the screen tube; suction means associated with the chamber so that refined dispersion is drawn through the perforations from the screen tube into the chamber while the contaminants are retained in the screen tube; means for rotating the screw to compact the contaminants at the discharge end of the screen tube; and means responsive to pressure of the compacted contaminants for discharging said compacted contaminants from the discharge end of the screen tube in a direction axially thereof.

2. Apparatus according to claim 1, wherein the outer periphery of the screw is in sliding fit relationship with the screen tube.

3. Apparatus according to claim 1, wherein the outer periphery of the screw is spaced from the screen tube by an amount in the range of about 0.002 inch to 0.025 inch.

4. Apparatus for removing contaminants from a slurry of colloidally dispersed asbestos fibers comprising: a horizontally disposed cylindrical jacket; a cylindrical perforated screen tube internally of said jacket and concentric therewith, the screen tube having an inlet end and an outlet end and being spaced from the jacket to form a chamber therebetween; a screw disposed for rotation within the screen tube; means for feeding slurry into the screen tube; suction means associated with the chamber so that refined dispersion is drawn through the perforations from the screen tube into the chamber while the contaminants are retained in the screen tube; means for rotating the screw to compact the contaminants at the discharge end of the screen tube; and a spring biased discharge door responsive to pressure of the compacted contaminants for removing compacted contaminants from the discharge end of the screen tube.

5. Apparatus for removing contaminants from a slurry of colloidally dispersed asbestos fibers comprising: a horizontally disposed cylindrical jacket; a cylindrical perforated screen tube internally of said jacket and concentric therewith, the perforations being separated from each other by an amount approximately equal to three-quarters of the length of the asbestos fibers in the slurry; the screen tube having an inlet end and an outlet end and being spaced from the jacket to form a chamber therebetween; a screw disposed for rotation within the screen tube; means for feeding slurry into the screen tube; suction means associated with the chamber so that refined dispersion is drawn through the perforations from the screen tube into the chamber while the contaminants are retained in the screen tube; means for rotating the screw to compact the contaminants at the discharge end of the screen tube; and means for removing compacted contaminants from the discharge end of the screen tube.

6. A method of removing contaminants from a slurry of colloidally dispersed asbestos fibers, comprising the steps of: feeding the contaminated slurry into a cylindrical, horizontally disposed tube having screw means extending for the full length thereof, the outer periphery of the screw means being in close proximity with the inner surface of the tube; forcing the slurry with the asbestos fibers out of the tube through a plurality of closely spaced openings in the wall of the tube, the openings being of a size and having a spacing so as to permit egress of said asbestos fibers but to retain the contaminants in the tube; simultaneously rotating the screw means to move the contaminants to the discharge end of the tube and compact them at said discharge end to remove excess slurry therefrom; and then removing said compacted contaminants from said tube responsive to compaction pressure.

* * * * *